United States Patent [19]

Brandell et al.

[11] Patent Number: 4,880,059

[45] Date of Patent: Nov. 14, 1989

[54] SLIDING SLEEVE CASING TOOL

[75] Inventors: John T. Brandell; Richard L. Giroux, both of Duncan, Okla.

[73] Assignee: Halliburton Company, Duncan, Okla.

[21] Appl. No.: 231,737

[22] Filed: Aug. 12, 1988

[51] Int. Cl.[4] ..... E21B 34/06; E21B 34/14

[52] U.S. Cl. ..... 166/332; 166/242; 166/316; 166/317; 251/343

[58] Field of Search ..... 166/154, 316–318, 166/332, 242, 289, 376, 386; 137/70; 251/318, 319, 343

[56] References Cited

U.S. PATENT DOCUMENTS

| | | | |
|---|---|---|---|
| 2,546,978 | 4/1951 | Collins et al. | 166/202 |
| 2,672,199 | 3/1954 | McKenna | 166/202 |
| 3,051,244 | 8/1962 | Litchfield | 166/317 |
| 3,057,405 | 10/1962 | Mallinger | 166/285 X |
| 3,071,193 | 1/1963 | Raulins | 166/332 |
| 3,151,681 | 10/1964 | Cochran | 166/332 |
| 3,312,280 | 4/1967 | Koplin | 166/285 |
| 3,355,142 | 11/1967 | Kammerer, Jr. et al. | 166/332 X |
| 3,768,562 | 10/1973 | Baker | 166/289 |
| 4,157,732 | 6/1979 | Fonner | 166/376 |
| 4,194,577 | 3/1980 | Vann | 175/4.51 |
| 4,269,278 | 5/1981 | Vann | 175/4.51 |
| 4,457,368 | 7/1984 | Knierimen et al. | 166/317 X |
| 4,512,406 | 4/1985 | Vann et al. | 166/318 X |
| 4,520,870 | 6/1985 | Pringle | 166/317 |

*Primary Examiner*—Bruce M. Kisliuk

*Attorney, Agent, or Firm*—James R. Duzan

[57] ABSTRACT

A sliding sleeve casing tool installed in a casing string comprising a housing, sliding sleeve, seal members and releasable retaining means to retain the sliding sleeve within the desired locations with the housing.

8 Claims, 6 Drawing Sheets

SLIDING SLEEVE CASING TOOL

BACKGROUND OF THE INVENTION

This invention relates to a selectively operable tool for use in wellbores to allow various operations to occur in formations surrounding a well. More specifically, this invention relates to a selectively operable tool to be installed in the casing in a wellbore to allow the surrounding formation at the location of the tool to be subjected to various operations through the tool with the tool being closed thereafter, thereby sealing the surrounding formation from producing into the casing.

In certain types of well cementing operations where it is desired to cement casing into a wellbore in stages, a selectively operable well cementing tool can be utilized to allow the flow of cement from the casing into the annulus surrounding the casing in the wellbore and then be closed to seal the flow of cement into the casing from the annulus. Such a prior art well cementing tool is shown in U.S. Pat. No. 3,768,562, issued to the assignee of the present invention. Another prior art version of this type well cementing tool where the movable sleeve is releasably retained within an initial position in tool is shown and described in U.S. patent application Ser. No. 183,416, filed Apr. 18, 1988, assigned to the assignee of the present invention.

Other types of well cementing tools which utilize cup-type packer elements in well cementing operations are shown and described in U.S. Pat. Nos. 2,546,978 and 2,672,199 and U.S. patent application Ser. Nos. 025,048, filed Mar. 12, 1987, assigned to the assignee of the present invention.

However, such prior art cementing tools are not generally suitable for use in wells where long sections of the formations surrounding the wellbore are to be treated, such as ten (10) feet or more, since they do not have sufficient flow area and ports therethrough. Also, such prior art cementing tools are not generally suitable for use in wells where portions of the wellbore are highly deviated having a short radius of deviation from the vertical portion of the wellbore since they are not resilient enough to be readily passed through the radius portion of the wellbore and, if forced, will be sufficiently damaged or deformed to prevent the sliding members of the tool remaining in or subsequent sealing engagement.

BRIEF STATEMENT OF THE INVENTION

In contrast to the prior art tools, the present invention is directed to a selectively operable tool to be installed in the casing for a wellbore to allow the surrounding formation interval of a preselected interval to be subjected to various operations through the tool with the tool being closed thereafter sealing the surrounding formation from producing into the casing. The present invention comprises, a housing, sliding sleeve, seal members and releasable retaining means to retain the sliding sleeve within the desired locations within the housing.

BRIEF DESCRIPTION OF THE DRAWINGS

The present invention will be more fully understood from the drawings and description of the invention wherein:

FIG. 6 is a cross-sectional view of one of the removable plugs located in the housing of the second embodiment of the present invention.

DETAILED DESCRIPTION OF THE INVENTION

Figure 1:
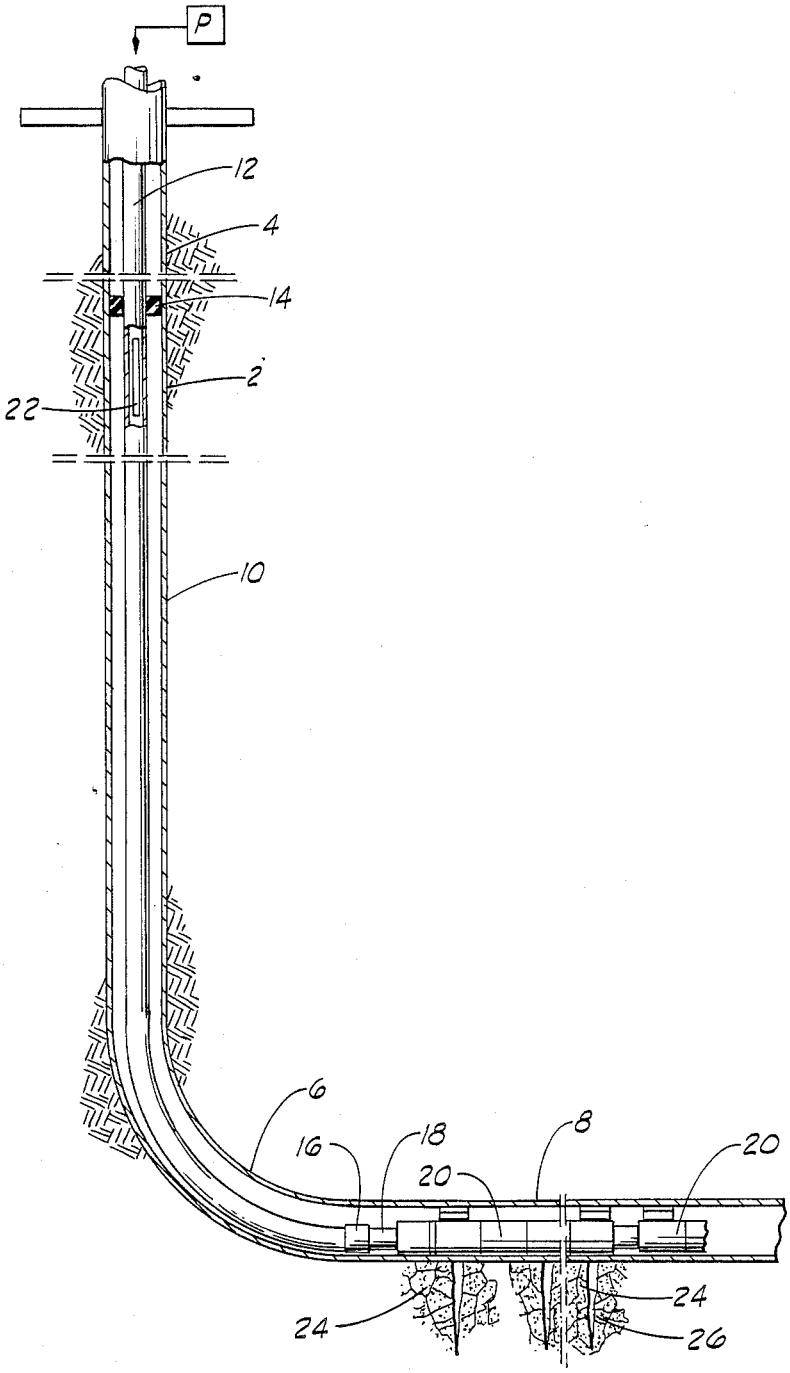
FIG. 1 PRIOR ART
FIG. 1 is a view of casing in a wellbore which has been perforated using a tubing conveyed perforating apparatus.

Referring to FIG. 1, a prior art method and apparatus for completing a well is shown. The apparatus and method are shown and described in U.S. Pat. Nos. 4,194,577 and 4,269,278.

Briefly, a wellbore 2 having a vertical portion 4, radius portion 6, and deviated portion 8 is shown. The wellbore 2 contains a casing 10 set therein having, in turn, tubing 12 therein; a packer 14 connected to the tubing 12, a swivel or steering tool 16 connected to the tubing 12, a vent 18 connected to the tool 16 and perforating gun 20. Upon actuation either by a drop bar go-devil 22 or hydraulic pressure, the perforating gun 20 perforates the casing and forms perforations 24 in the surrounding formation.

While this apparatus and method of well completion is satisfactory, in instances where expensive well completion fluids are used to fill the casing 10 and where the formation takes fluid upon being exposed to the completion fluid and the hydrostatic pressure it exerts on the formation 26 after being perforated, it is desirable to have a completion apparatus and method to prevent the loss of completion fluids when completing a well and which can seal off the completed formation in the well, as desired, so that other formations surrounding the casing 10 in the wellbore 2 can be completed and produced. It is also desirable to have an apparatus and method for use in highly deviated holes having a small radius of curvature portions.

Figure 2:
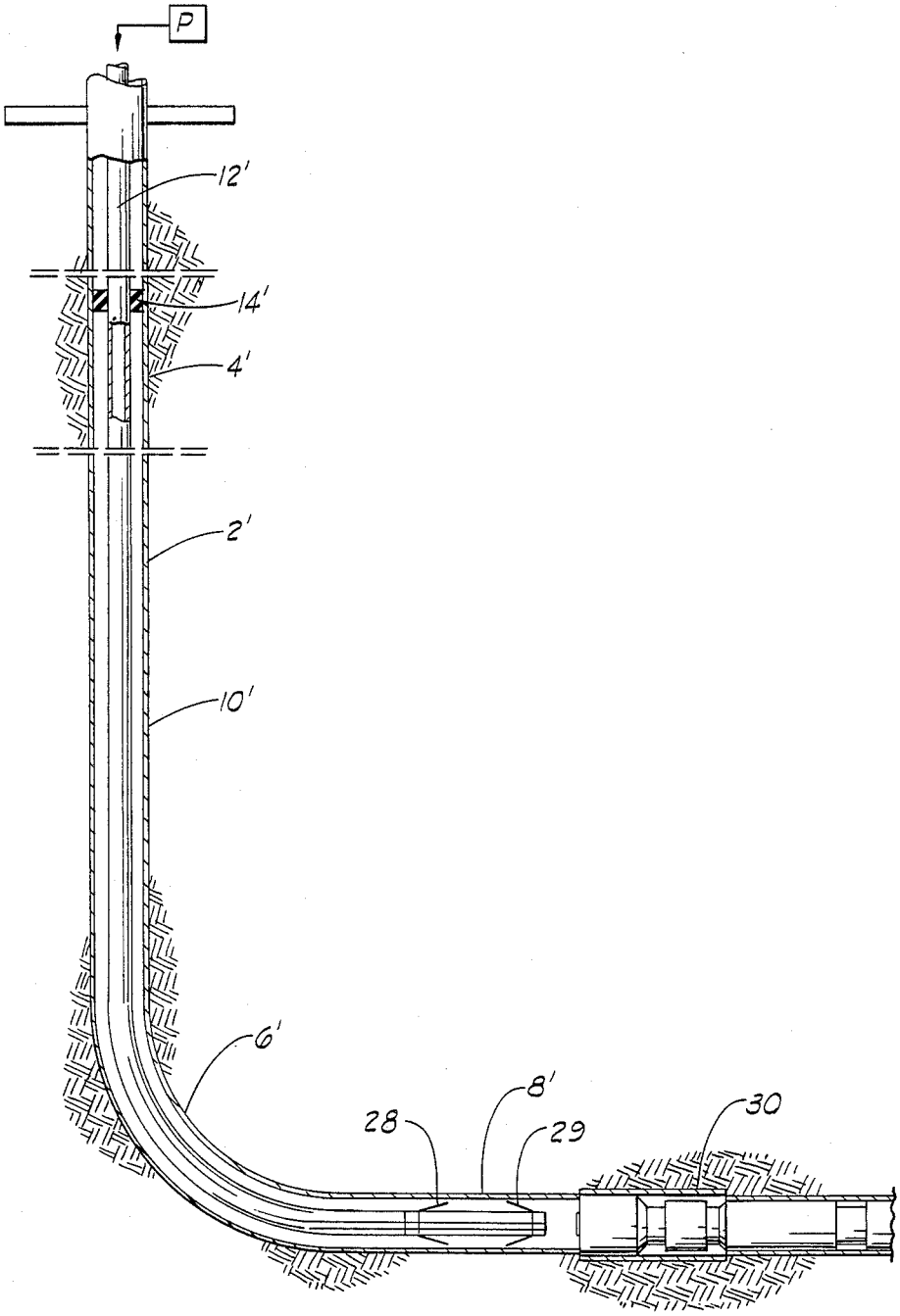
FIG. 2 is a view of casing in a wellbore which has the present invention installed therein with an operating device therefore installed on tubing in the casing.

Referring to FIG. 2, a well having a wellbore 2' having, in turn, a vertical portion 4', radius portion 6', and deviated portion 8' is shown. The wellbore 2' contains a casing 10' having the full opening selectively operable formation evaluation tool 30 of the present invention installed therein. The casing 10'further contains tubing 12' therein, packer 14' connected to the tubing 12', an opening tool 28 to open the formation evaluation tool 30 of the present invention and a closing tool 29 to close the formation evaluation tool 30 of the present invention.

Figure 3:
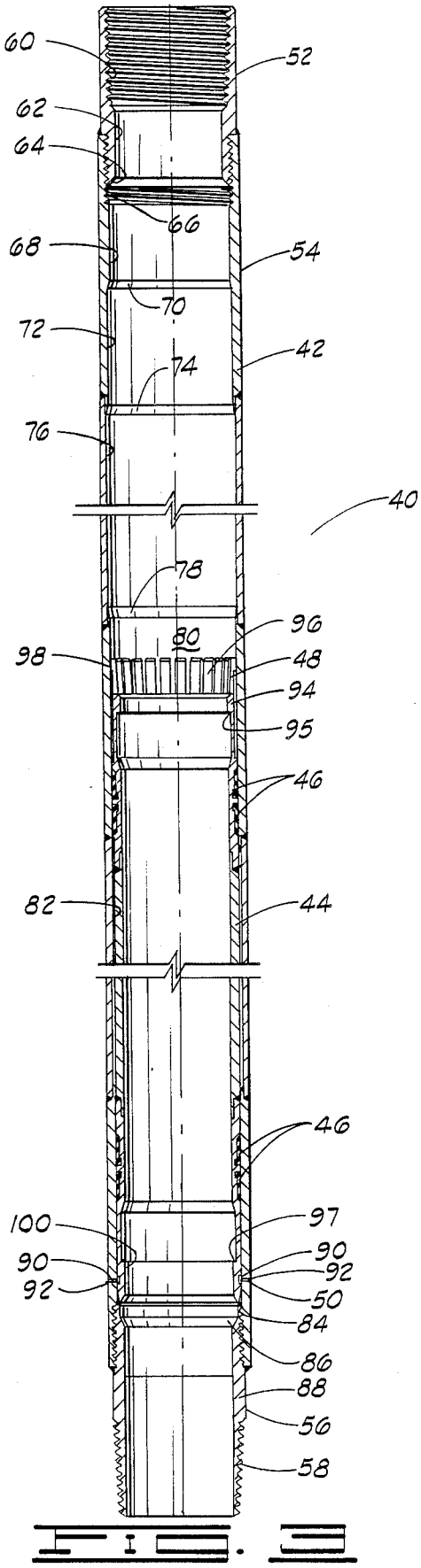
FIG. 3 is a cross-sectional view of one embodiment of the present invention.

Referring to FIG. 3, the first tool embodiment 40 of the formation evaluation tool 30 of the present invention is shown. The tool 40 comprises a housing 42, sliding sleeve 44, cup-type seal members 46, first releasable retaining means 48 and second retaining means 50, the first 48 and second 50 retaining means retain the sliding sleeve 44 within the housing 42 in desired positions therein.

The housing 42 comprises an elongated annular cylindrical member having, on the exterior thereof, first cylindrical surface 52, second cylindrical surface 54, third cylindrical surface 56 and threaded surface 58, and, on the interior thereof, threaded bore 60, first cylindrical bore 62, first annular frusto-conical surface 64, cylindrical annular recess 66, second cylindrical bore 68, second annular frusto-conical surface 70, third cylindrical bore 72, third annular frusto-conical surface 74, fourth cylindrical bore 76, fourth annular frusto-conical surface 78, fifth cylindrical bore 80, sixth cylindrical bore 82, seventh cylindrical bore 84, fifth annular frusto-conical annular surface 86 and eighth cylindrical bore 88. The housing 42 further contains a plurality of threaded apertures 90 having threaded members 92 therein which comprise the second releasable retaining means 50. Alternately a shear ring and annular recess in both the housing 42 and sliding sleeve 44 may be used to retain the sleeve 44 in a first position in the housing 42.

The sliding sleeve 44 comprises an elongated annular cylindrical member slidably disposed within the housing 42 having a plurality of cup-type annular elastomeric seal members 46 thereon slidably, sealingly engaging the various interior bores, such as 72, 74, 80 and 82, of the housing 42, having a first releasably retaining means 48 on one end thereof which comprises a collet sleeve 94 having, in turn, a plurality of collet fingers 96 continuing enlarged heads 98, having an annular shoulder 95 on one end thereof in the interior thereof, having an annular recess 100 formed in the exterior thereof which receives a portion of each threaded member 92 therein to retain the sliding sleeve in a first position within the housing 42, and having annular shoulder 97 on the interior of the other end thereof.

Figure 4:
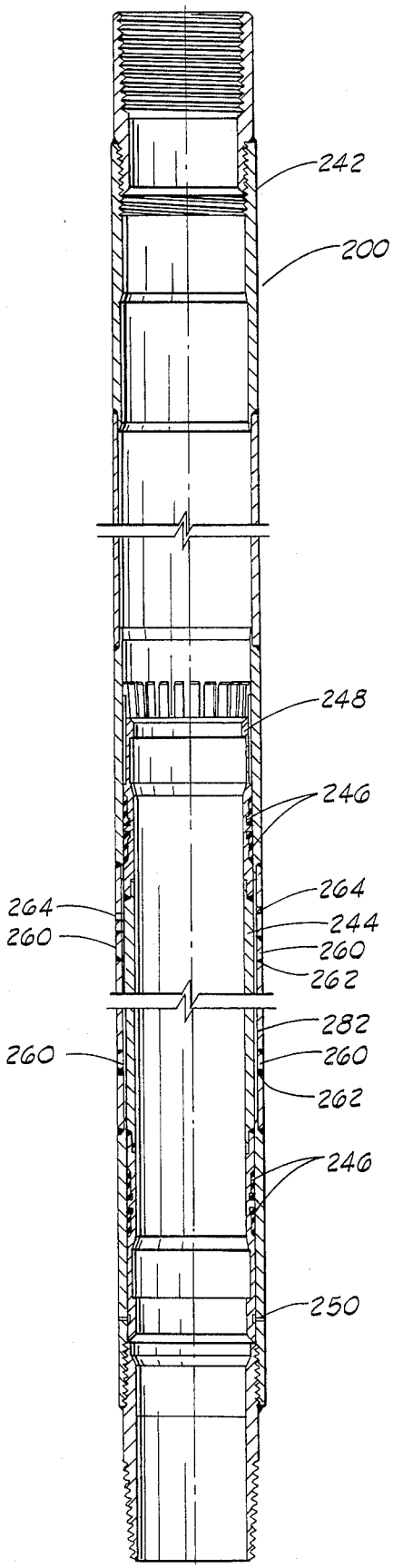
FIG. 4 is a cross-sectional view of a second embodiment of the present invention.

Referring to FIG. 4, the second tool embodiment 200 of the formation evaluation tool 30 of the present invention is shown. The tool 200 comprises a housing 242, sliding sleeve 244, cup-type seal members 246, first releasable retaining means 248 and second retaining means 250, the first 248 and second 250 retaining means retaining the sliding sleeve 244 within the housing 242 in the desired positions therein.

The second tool embodiment 200 is similar to the first tool embodiment 40 except for threaded inserts 260 in threaded apertures 262 and apertures 264 in the housing 242. The threaded inserts 260 are made of easily dissolvable material, such as aluminum, to be easily removed from the aperatures 262 upon contact by corrosive fluids, such as acid.

Figure 5:
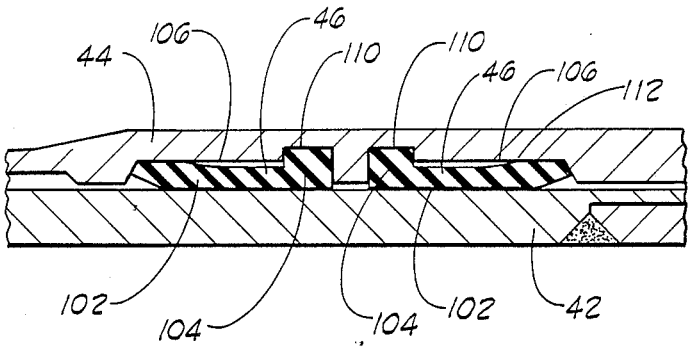
FIG. 5 is a cross-sectional view of a portion of the annular cup-type sealing members installed on the sliding sleeve of the present invention.
Figure 5:
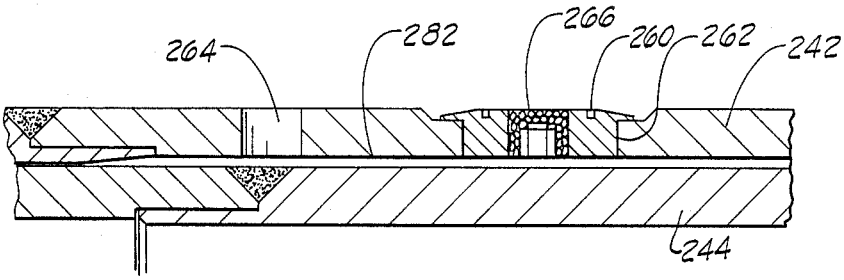

Referring to FIG. 5, an enlarged view of the cup-type seal members 46, or alternately 246, are shown. Each cup-type seal member 46 comprises an elastomeric annular member having a frusto-conical portion 102 which slidingly, sealingly engages various bores of housing 42, such as bores 72, 74, 80 and 82 and having annular circumferential lug portion 104. Each cup-type seal member 46 is retained within recess 106 of the sliding sleeve 44 with the annular circumferential lug portion 104 being retained in annular recess 110 of the sliding sleeve 44. The cup-type seal members 46 are installed in pairs on the sliding sleeve 44 having their frusto-conical portions 102 facing oppositely with respect to the centerline of the tool 40, with their lips 112 forcing oppositely with respect to the centerline of the tool 40, and their annular lug portions 104 adjacent each other. In this manner, the cup-type seal members 46 can prevent fluid flow in the annulus between the housing 42 and sliding sleeve 44 in either longitudinal direction along the tool 40.

Cup-type elastomeric seal members 46 are required to slidingly, sealingly seal between the housing 42 and sliding sleeve 44 as the sliding sleeve 44 is significantly smaller in diameter than the bores 76 or 82 of the housing 42 to allow flexing and deformation of the tool 40 or 200 when it is run along the associated casing in the wellbore. If it is attempted to use annular elastomeric O-ring type seals or D-ring type seals in place of the cup-type seal members 46, after running the casing and one or more tools 40 into the wellbore, the O-ring type seals or D-ring seals may not seal between the housing 42 and sliding sleeve 44 in all cases because the housing and or sliding sleeve have been deformed.

Referring to FIG. 6, an enlarged view of the threaded inserts 260 retained in threaded apertures 262 and the apertures 264 in housing 242 are shown. The entire threaded insert 260 may be made of readily dissolvable material, such as aluminum, or only a portion thereof, such as portion 266, as shown.

The apertures 264 are provided to allow fluid to escape from being trapped during movement of the sliding sleeve 244 relative to the housing 242.

Figure 7A:
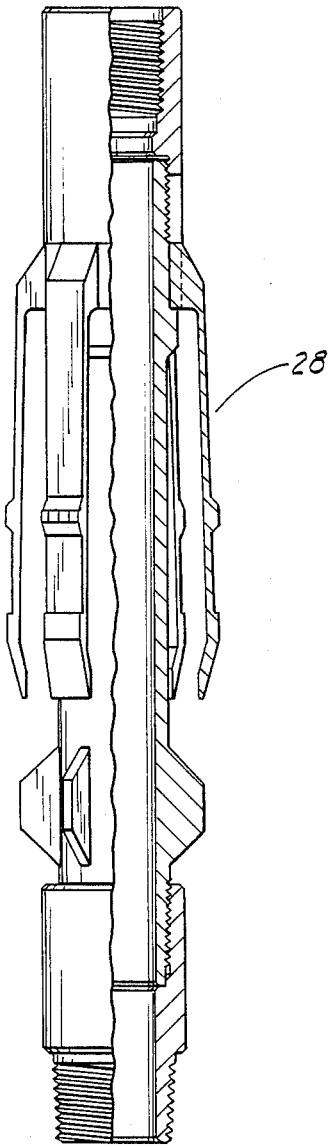
FIG. 7A is a sectional view of the opening tool used with the present invention.
Figure 7B:
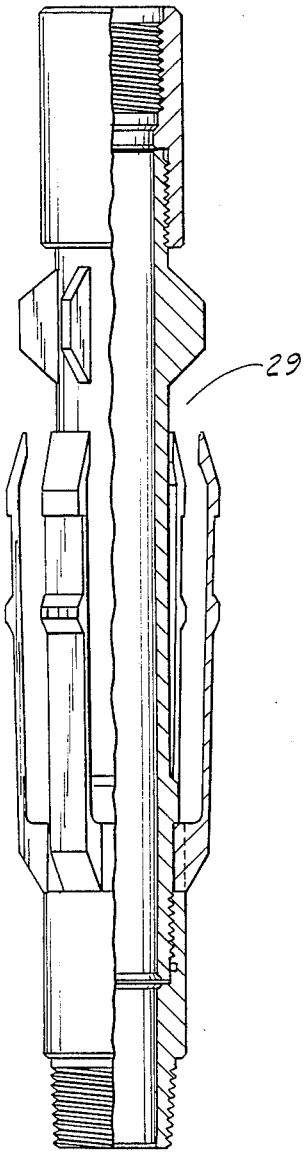
FIG. 7B is a sectional view of the closing tool used with the present invention.

Referring to FIGS. 7A and 7B, the opening tool 28 and closing tool 29 for either of the tools 40 or 200 are shown. The opening 28 and closing tools 29 are shown and described in U.S. Pat. No. 3,768,562 which is incorporated herein by reference.

OPERATION OF THE TOOL

Referring to FIG. 2 and FIG. 3 the operation of the first tool embodiment 40 of the formation evaluation tool 30 will be set forth.

The tool 40 is made up into the casing string 10' at its desired wellbore 8' location and the casing string 10' is run into the wellbore 2'. As shown in FIG. 2 a desired portion of the casing 10' may be cemented in the wellbore 2', such as vertical portion 4' of the wellbore 2'.

When it is desired to complete the wellbore portion 8' to evaluate the surrounding formation, a tubing string 12' having opening 28 and closing 29 tools thereon is run into the casing until a portion of opening tool 28 engages annular shoulder 95 of the tool 40. At this time, the tubing string 12' is pulled upwardly causing the opening tool 28 to slide the sliding sleeve upwardly in the housing 42 after the threaded members 92 or shear ring of the second releasing means 50 are sheared until the enlarged heads 98 of the collet fingers 96 on collet sleeve 94 engage annular recess 66 in housing 42. Since further upward movement of the sliding sleeve 44 in housing 42 is prevented by the enlarged heads 98 of the collet sleeve 94 abutting the upper shoulder of annular recess 66 in housing 42, the continued upward movement of tubing string 12' having opening tool 28 thereon causes the opening 28 and closing 29 tools to pass through the tool 40 so that the tubing string 12' may be removed from the casing 10'.

At this point, a suitable perforating apparatus, such as the tubing conveyed perforating apparatus shown in FIG. 1, is run into the casing 10' and positioned in sixth cylindrical bore 82 of housing 42 and bore 82 of housing 42 is perforated to allow fluids from the surrounding formation to flow into the casing 10'. Subsequent to the perforation of the housing 42, the perforating apparatus is removed from the casing string 10' and a tool string having opening 28 and closing 29 tools thereon is inserted into the casing 10' to allow selective closing of the sliding sleeve 44 over the perforations in sixth cylindrical bore 82 of housing 42 thereby preventing the flow of surrounding formation fluids through the perforations in the bore 82 of housing 42 and into the casing 10' by the cup-type seal members 46 on sliding sleeve 44 sealingly engaging bore 82 of housing 42. Alternately, opening of the sliding sleeve 44 is accomplished by sliding the sliding sleeve 44 upwardly in housing 42 until a portion of the collet sleeve 94 engages annular recess 66 in housing 42 thereby allowing fluid flow through the perforations in the bore 82 of housing 42. In this manner, if desired, the sliding sleeve 44 may be left in its closed position preventing flow into the casing 10' to allow another portion of the casing 10' to be perforated or the well to be abandoned.

Referring to FIG. 2 and FIG. 4, the operation of the second tool embodiment 200 of the formation evaluation tool 30 will be described. The opening and closing of the sliding sleeve 244 in the housing 242 is the same as that previously described with respect to the first tool embodiment 30.

However, rather than perforating bore 282 of housing 242, flow openings are formed in the housing 24 by dissolving a portion or all of the threaded inserts 260 in the housing 242 by the use of corrosive fluid, such as acid, which may be pumped through the tubing string 12' having opening 28 and closing 29 tools thereon.

It should be noted from the foregoing that the formation evaluation tool 30 may be of any desired length to allow any desired number and pattern of perforations or flow openings to be made by varying the length of bore 82 or 282 of housing 42 or 242 respectively and the corresponding length of sliding sleeve 44 between the pairs of cup-type seal members 46 thereon. Also, it should be noted that any number of formation evaluation tools 30 can be installed in the casing 10' at any desired locations therein to allow the selective completion of formations surrounding the wellbore 2'.

It will be obvious to those skilled in the art that modifications, alterations, additions, and deletions can be made to the present invention which are encompassed therein.

Having thus described our invention, we claim:

1. A sliding sleeve casing tool installed in a string of casing in a well bore intersecting a plurality of formations of the earth, said sliding sleeve casing tool for use in evaluating the characteristics of a formation surrounding said sliding sleeve casing tool of said plurality of formations, said sliding sleeve casing tool capable of being repeatedly opened and closed any desired number of times to allow fluids to be selectively produced from said formation and, if desired, fluids to flow from said casing into said formation when apertures allowing fluid communication between the exterior and interior of said sliding sleeve casing tool have been created therein, said sliding sleeve casing tool comprising:

an annular housing secured in said string of casing at a desired location for evaluating the characteristics of said formation, the annular housing having a longitudinal axis therethrough;

a sliding sleeve slidable within the annular housing from first desired location to a second desired location therein, the sliding sleeve having a longitudinal axis therethrough substantially parallel to the longitudinal axis of the annular housing and forming an annulus between the annular housing and the exterior of the sliding sleeve;

cup-type seal members retained on the sliding sleeve to slidingly, sealingly engage the interior of the annular housing to prevent fluid flow in either direction longitudinally in the annulus formed between the annular housing and the sliding sleeve;

first releasable retaining means attached to the sliding sleeve to allow the sliding sleeve to be releasably retained at a second desired location in the annular housing;

and second retaining means extending between the annular housing and the sliding sleeve to allow the sliding sleeve to be initially retained within the annular housing in a first position therein;

whereby when apertures have been formed in the annular housing after the installation of said sliding sleeve casing tool in said string of casing and said string of casing is installed in said well bore to allow fluid communication between the interior of the annular housing and the exterior thereof, the sliding sleeve may be repeatedly moved between the first location and the second location in the annular housing so that when the sliding sleeve is in its first location, the sliding sleeve seals the interior of the annular housing to prevent fluid communication from the exterior of the annular housing to the interior of the sliding sleeve thereby preventing the flow of fluids from the formation into said casing and when the sliding sleeve is in its second desired location, the sliding sleeve allows fluid communication from the exterior of the annular housing to the interior of the sliding sleeve thereby allowing fluids to be selectively produced from said formation and, if desired, fluids to flow from said casing into said formations.

2. The formation evaluation tool of claim 1 wherein: the annular housing includes a plurality of threaded inserts therein which are readily dissolvable through the use of corrosive fluids.

3. The formation evaluation tool of claim 1 wherein: the cup-type seal members comprise resilient elastomeric members.

4. The formation evaluation tool of claim 1 wherein: the first releasable retaining means comprises a collet sleeve attached to one end of the sliding sleeve.

5. The formation evaluation tool of claim 1 wherein: the second retaining means comprise a plurality of shearable members having a portion thereof engaging the annular housing and a portion thereof engaging the sliding sleeve.

6. The formation evaluation tool of claim 1 wherein: the second retaining means comprises a shear ring having a portion thereof engaging the annular housing and a portion thereof engaging the sliding sleeve.

7. A sliding sleeve casing tool installed in a string of casing in a well bore intersecting a plurality of formations of the earth, said sliding sleeve casing tool for use in evaluating the characteristics of a formation surrounding said sliding sleeve casing tool of said plurality of formations, said sliding sleeve casing tool capable of being repeatedly opened and closed any desired number of times to allow fluids to be selectively produced from said formation and, if desired, fluids to flow from said casing into said formation when apertures allowing fluid communication between the exterior and interior of said sliding sleeve casing tool have been created therein, said sliding sleeve casing tool comprising:

an annular housing secured in said string of casing at a desired location for evaluating the characteristics of said formation, the annular housing having a longitudinal axis therethrough; and having a portion thereof having, in turn, a plurality of threaded inserts therein which are readily dissolved through the use of corrosive fluids;

a sliding sleeve slidable within the annular housing between a first position covering the plurality of threaded inserts in the annular housing and a second position uncovering the plurality of threaded inserts in the annular housing, the sliding sleeve having a longitudinal axis therethrough substantially parallel to the longitudinal axis of the annular housing and forming an annulus between the annular housing and the exterior of the sliding sleeve;

resilient elastomeric cup-type seal members retained on the sliding sleeve to slidingly, sealingly engage the interior of the annular housing to prevent fluid flow in either direction longitudinally in the annulus formed between the annular housing and the sliding sleeve;

first releasable retaining means attached to the sliding sleeve to allow the sliding sleeve to be releasably retained at a second desired location in the annular housing, the first releasable retaining comprises:

a collet sleeve attached to one end of the sliding sleeve; and second retaining means extending between the annular housing and the sliding sleeve to allow the sliding sleeve to be initially retained within the annular housing in a first position therein, the second retaining means comprising:

at least one shearable member having a portion thereof engaging the annular housing and a portion thereof engaging the sliding sleeve;

wherein when apertures have been formed in the annular housing after the installation of said sliding sleeve casing tool in said string of casing and said string of casing installed in said well bore to allow fluid communication between the interior of the annular housing and the exterior thereof, the sliding sleeve may be repeatedly moved between the first location and the second location in the annular housing so that when the sliding sleeve is in its first location, the sliding sleeve seals the interior of the annular housing to prevent fluid communication from the exterior of the annular housing to the interior of the sliding sleeve thereby preventing the flow of fluids from the formation into said casing and when the sliding sleeve is in its second desired location, the sliding sleeve allows fluid communication from the exterior of the annular housing to the interior of the sliding sleeve thereby allowing fluids to be selectively produced from said formation and, if desired, fluids to flow from said casing into said formations.

8. A sliding sleeve casing tool installed in a string of casing in a well bore intersecting a plurality of formations of the earth, said sliding sleeve casing tool for use in evaluating the characteristics of a formation surrounding said sliding sleeve casing tool of said plurality of formations, said sliding sleeve casing tool capable of being repeatedly opened and closed any desired number of times to allow fluids to be selectively produced from said formation and, if desired, fluids to flow from said casing into said formation when apertures allowing fluid communication between the exterior and interior of said sliding sleeve casing tool have been created therein, said sliding sleeve casing tool comprising:

an annular housing secured in said string of casing at a desired location for evaluating the characteristics of said formation, the annular housing having a longitudinal axis therethrough;

a sliding sleeve slidable within the annular housing between a first position covering a portion of the annular housing and a second position uncovering a portion of the annular housing, the sliding sleeve having a longitudinal axis therethrough substantially parallel to the longitudinal axis of the annular housing and forming an annulus between the annular housing and the exterior of the sliding sleeve;

resilient elastomeric cup-type seal members retained on the sliding sleeve top slidingly, sealingly engage the interior of the annular housing to prevent fluid flow in either direction longitudinally in the annulus between the annular housing and the sliding sleeve;

first releasable retaining means attached to the sliding sleeve to allow the sliding sleeve to be releasably retained at a desired location in the annular housing, the first releasable retaining comprises:

a collet sleeve attached to one end of the sliding sleeve; and second retaining means extending between the annular housing and the sliding sleeve to allow the sliding sleeve to be initially retained within the annular housing in a first position therein, the second retaining means comprising:

at least one shearable member having a portion thereof engaging the annular housing and a portion thereof engaging the sliding sleeve;

whereby when apertures have been formed in the annular housing after the installation of said sliding sleeve casing tool in said string of casing and said string of casing installed in said well bore to allow fluid communication between the interior of the annular housing and the exterior thereof, the sliding sleeve may be repeatedly moved between the first location and the second location in the annular housing so that when the sliding sleeve is in its first location, the sliding sleeve seals the interior of the annular housing to prevent fluid communication from the exterior of the annular housing to the interior of the sliding sleeve thereby preventing the flow of fluids from the formation into said casing and when the sliding sleeve is in its second desired location, the sliding sleeve allows fluid communication from the exterior of the annular housing to the interior of the sliding sleeve thereby allowing fluids to be selectively produced from said formation and, if desired, fluids to flow from said casing into said formations.

* * * * *